US006467842B1

(12) United States Patent
Lu

(10) Patent No.: US 6,467,842 B1
(45) Date of Patent: Oct. 22, 2002

(54) LOCATING STRUCTURE OF A RECLINING LEISURE CHAIR

(75) Inventor: Chieh-Tsung Lu, Taichung Hsien (TW)

(73) Assignee: Aur Hann Co., Ltd., Taichung Hsien (TW)

( * ) Notice: Subject to any disclaimer, the term of this patent is extended or adjusted under 35 U.S.C. 154(b) by 0 days.

(21) Appl. No.: 09/828,667

(22) Filed: Apr. 9, 2001

(51) Int. Cl.[7] ..... A47C 1/035

(52) U.S. Cl. ..... 297/316; 297/374; 297/317; 297/322; 297/323

(58) Field of Search ..... 297/316, 317, 297/318, 322, 323, 320, 340, 374

(56) References Cited

U.S. PATENT DOCUMENTS 4,768,829 A * 9/1988 Goldman ..... 297/317
5,005,905 A * 4/1991 Sondergedl ..... 297/281
5,211,444 A * 5/1993 Kjellman ..... 297/317
5,356,200 A * 10/1994 Stumpf et al. ..... 297/301.1
5,560,682 A * 10/1996 Brown ..... 297/316
5,676,425 A * 10/1997 Pernicka ..... 297/374

* cited by examiner

*Primary Examiner*—Anthony D. Barfield
(74) *Attorney, Agent, or Firm*—Harrison & Egbert

(57) ABSTRACT

A reclining leisure chair includes a main body, a locating member mounted in the rear edge of the main body, and two sliding members mounted in the front edge of the main body. The locating member is formed of a U-shaped frame seat, an action member, a resilient member, an auxiliary piece, a clamping piece, an arresting member, a bolt, and an action rod. The locating member works with ease and without jamming the sliding members.

33 Claims, 17 Drawing Sheets

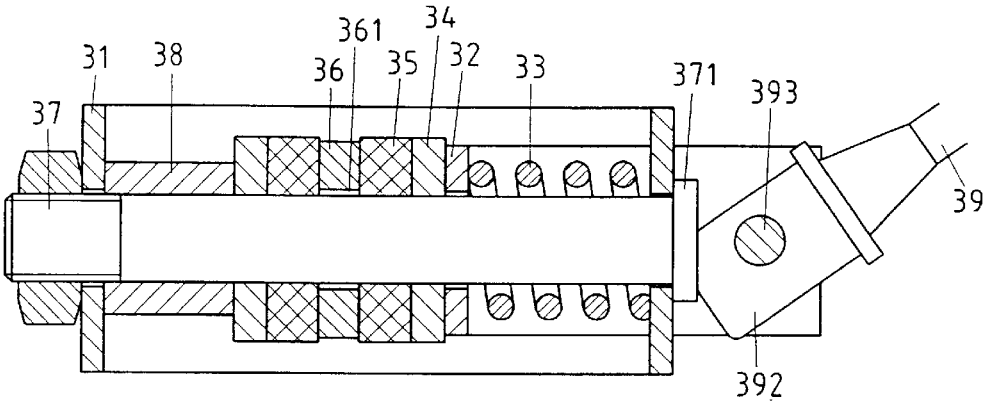
FIG.14-A
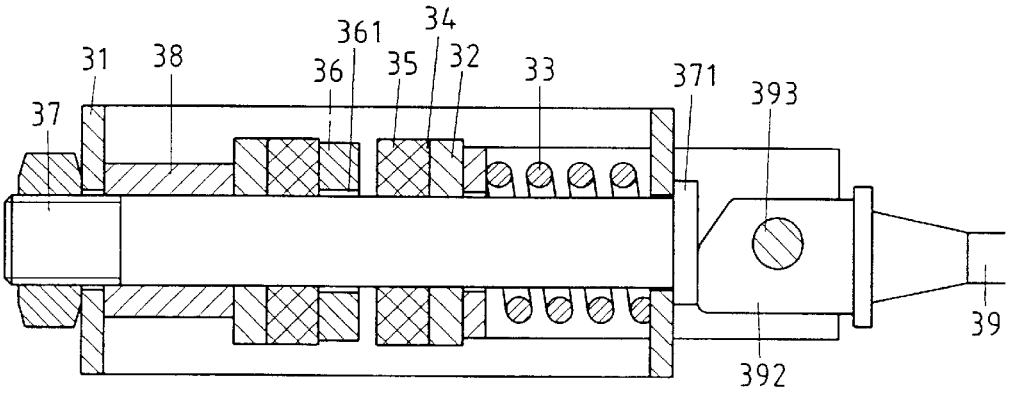
FIG.14-B

LOCATING STRUCTURE OF A RECLINING LEISURE CHAIR

BACKGROUND OF THE INVENTION

1. Field of the Invention

The present invention relates generally to a reclining leisure chair, and more particularly to a locating structure of the reclining leisure chair.

2. Description of Related Art

As shown in FIGS. 1 and 2, a reclining leisure chair of the prior art has a reclining frame 10, which is provided with a slidable rod set 11. The slidable rod set 11 is provided in an appropriate position thereof with a locating member 12 which is in turn provided with an operation portion 121. The reclining frame 10 can be adjusted for reclining by loosening up the operation portion 121 to enable the slidable rod set 11 to be displaced. When the reclining frame 10 is in the reclining state, it is rather inconvenient for a person seated on the reclining frame 10 to reach for the locating member 12. The person might even have to stand up to take hold of the portion 121 of the locating member 12. In addition, the slidable rod set 11 and the locating member 12 are apt to jam together, especially after the reclining frame 10 is kept in the reclining state for a prolonged period of time. It is conceivable that the reclining frame 10 of the prior art leisure chair cannot be easily readjusted because of the jamming of the slidable rod set 11 and the locating member 12.

BRIEF SUMMARY OF THE INVENTION

The primary objective of the present invention is to provide a reclining leisure chair with a locating structure which is free of the drawbacks of the locating structure of the prior art reclining leisure chair described above.

In keeping with the principle of the present invention, the foregoing objective of the present invention is attained by a reclining leisure chair which is formed of a main body, a locating member mounted in the rear edge of the main body, and two sliding members mounted respectively in two sides of the front edge of the main body. The locating member is formed of a U-shaped frame seat, an action member, a resilient member, an auxiliary piece, a clamping piece, an arresting member, a bolt, and an action rod. The locating member of the present invention can be easily operated, without jamming the sliding members.

The objective, features and functions of the present invention will be more readily understood upon a thoughtful deliberation of the following detailed description of the present invention in reference to the accompanying drawings.

BRIEF DESCRIPTION OF THE SEVERAL VIEWS OF THE DRAWINGS

FIG. 14A shows a sectional schematic view of the present invention.

FIG. 14B shows another sectional schematic view of the present invention.

DETAILED DESCRIPTION OF THE INVENTION

Figure 1:
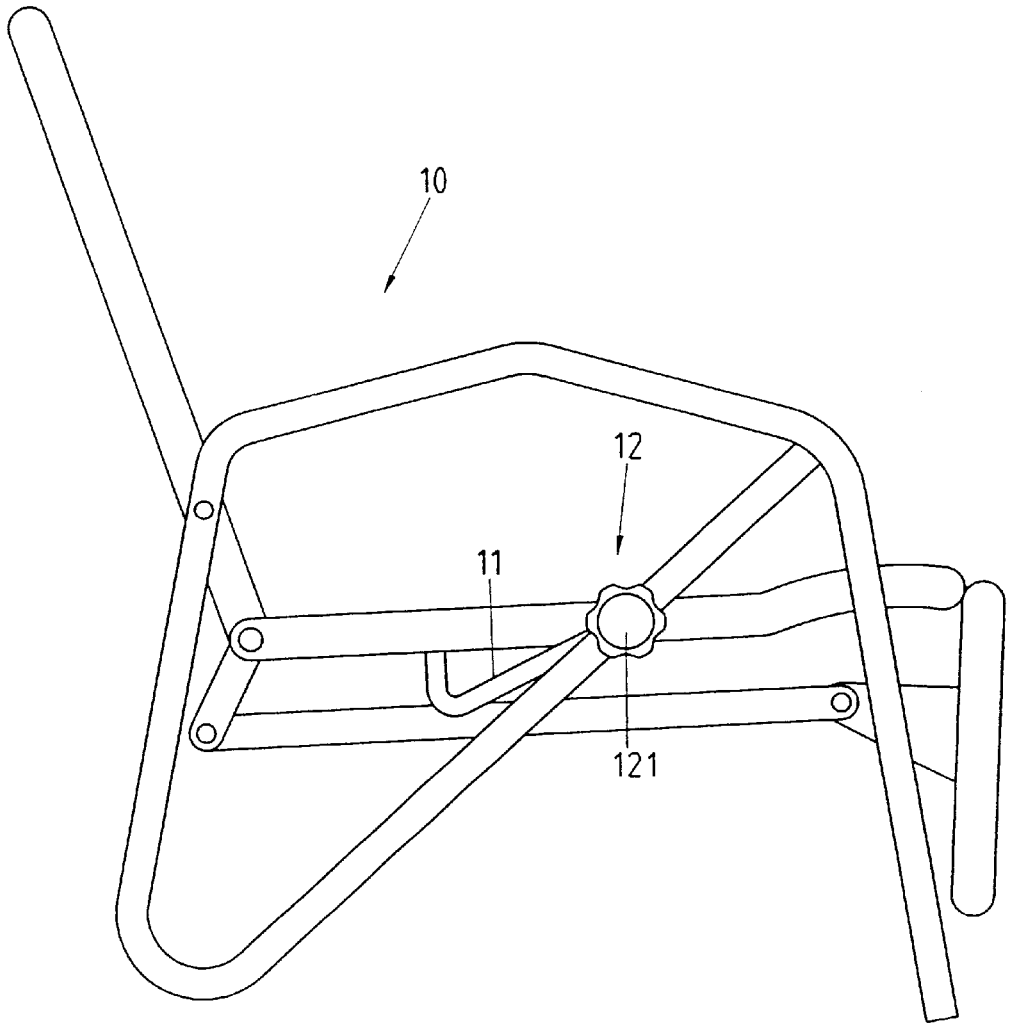
FIG.1 PRIOR ART
FIG. 1 shows a side schematic view of a reclining leisure chair of the prior art.
Figure 2:
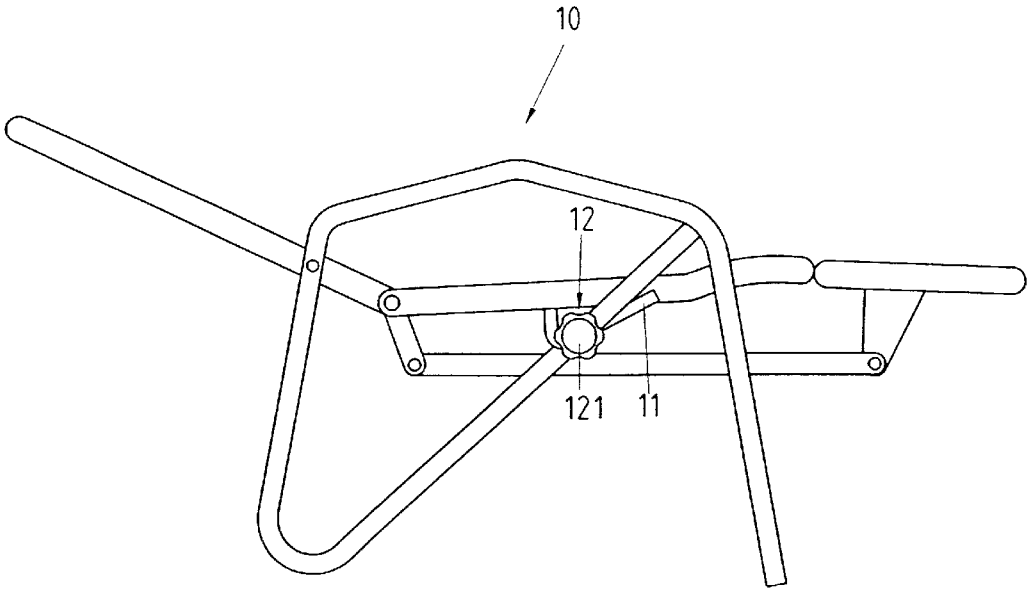
FIG. 2 PRIOR ART
FIG. 2 shows a side schematic view of the prior art reclining leisure chair in the reclining state.

As shown in FIGS. 3–8, a reclining leisure chair of the present invention comprises a main body 20, a locating member 30 mounted in the rear edge of the main body 20, and two sliding members 40 mounted in two sides of the front edge of the main body 20.

The locating member 30 comprises the component parts which are described hereinafter.

A U-shaped frame seat 31 is formed of a board by bending and is provided in two sides thereof with a coaxial hole 311. One of the two coaxial holes 311 is provided in the upper side and the lower side with a long hole 312 for disposing an action member 32 in conjunction with a resilient member 33, an auxiliary piece 34, a clamping piece 35, an arresting member 36, a liner 38, and a bolt 37 for fastening the above component parts in the U-shaped frame seat 31.

The action member 32 is integrally made of a board by bending and is mounted in the long hole 312 of the U-shaped frame seat 31 such that the action member 32 cooperates with the frame seat 31 to set up the resilient member 33, such that the action member 32 presses against the auxiliary piece 34, and such that the action member 32 is provided with an action rod 39 pivoted thereto.

The resilient member 33 is disposed between the U-shaped frame seat 31 and the action member 32 is fitted over the bolt 37.

The auxiliary piece 34 is located in the U-shaped frame seat 31 by the bolt 37 such that the auxiliary piece 34 is contiguous to the action member 32 and the clamping piece 35.

The champing piece 35 is located in the U-shaped frame seat 31 and is contiguous to the auxiliary piece 34 and the arresting member 36.

The arresting member 36 is provided with a position confining hole 361 in which the bolt 37 is received. The arresting member 36 is in contact with the clamping piece 35 and is provided with a pivoting piece 362 enabling the arresting member 36 to swivel.

The bolt 37 has an appropriate length and a stop end 371. The bolt 37 is put through the coaxial holes 311 of the U-shaped frame seat 31 to locate the action member 32, the resilient member 33, the auxiliary piece 34, the clamping piece 35, the arresting member 36, and the liner 38.

The action rod 39 has a wrenching end 391, and an action end 392 which is pivoted with the action member 32 by an insertion pin 393.

Figure 5:
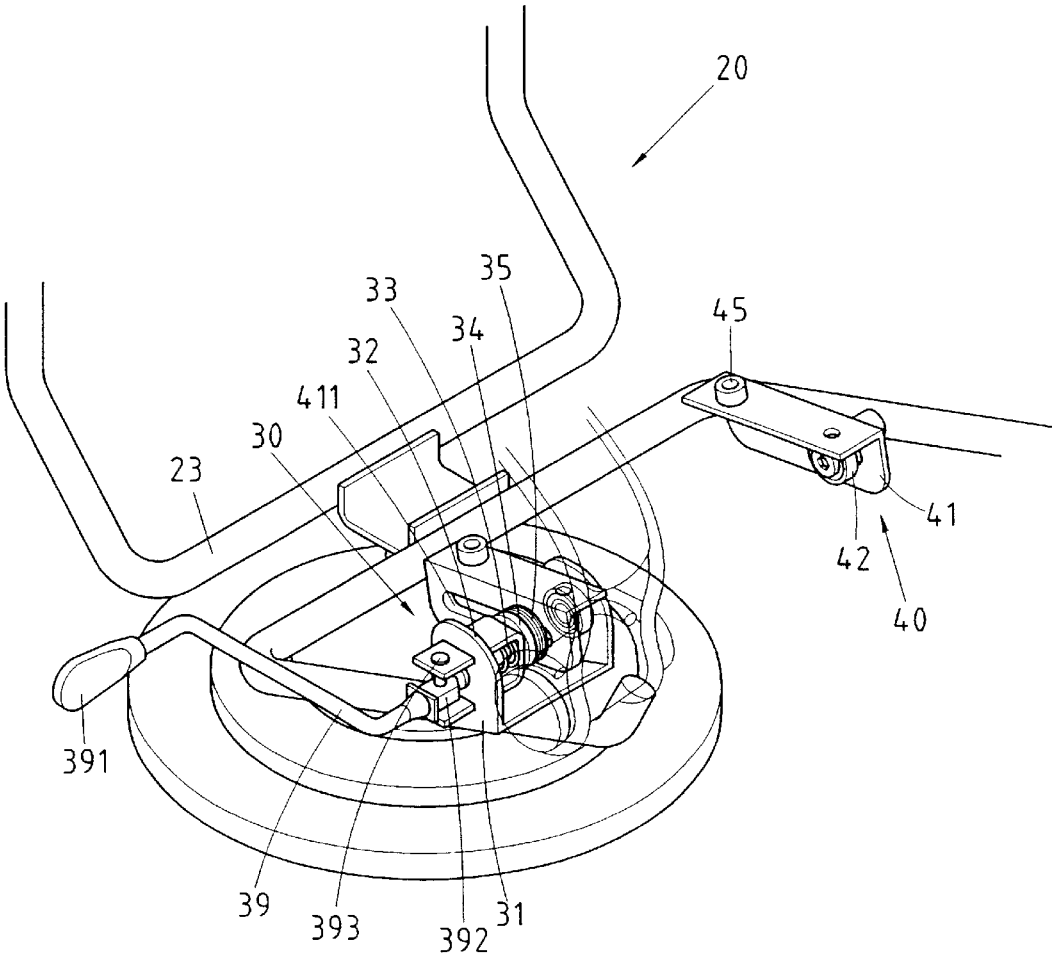
FIG. 5 shows another perspective view of the present invention.
Figure 6:
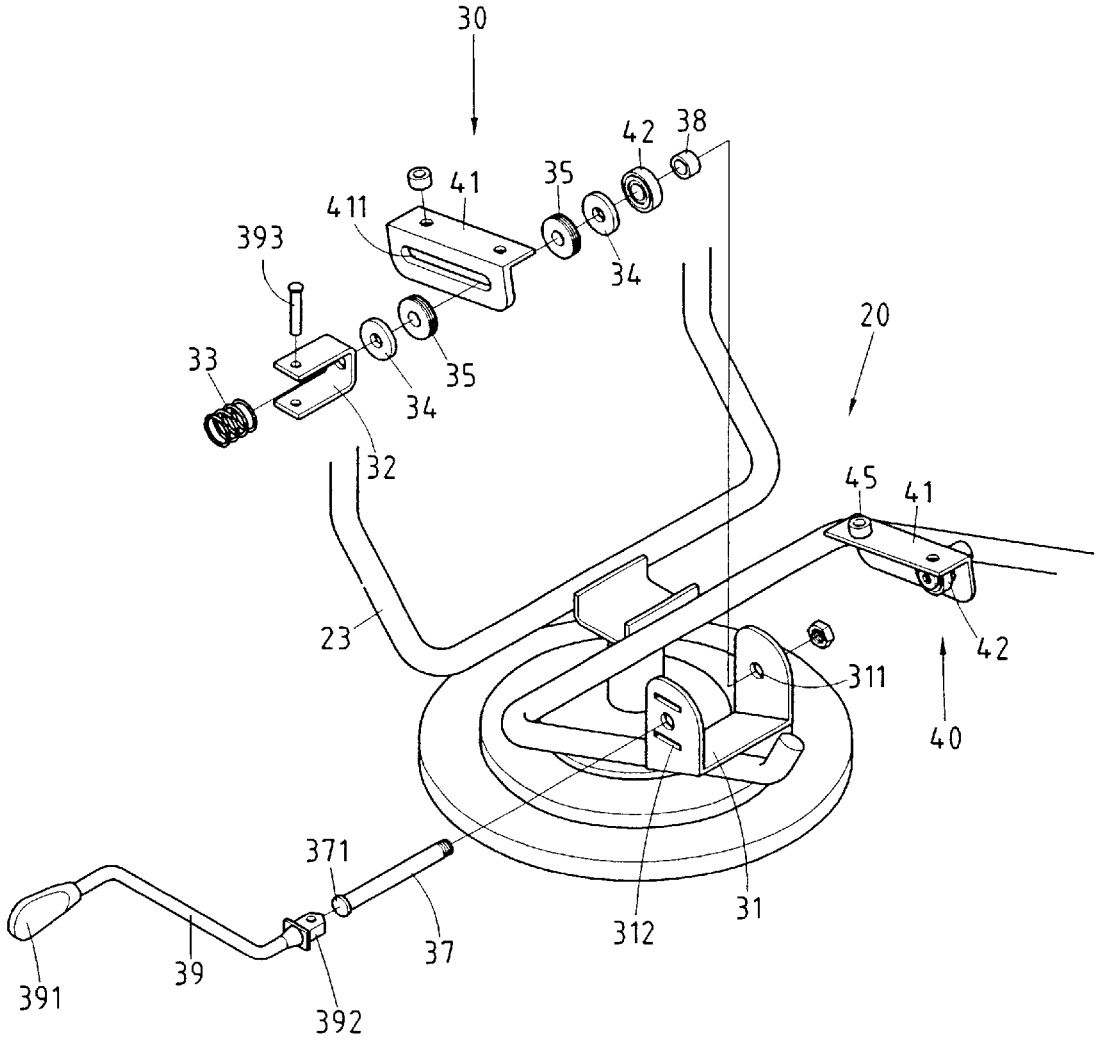
FIG. 6 shows another exploded view of the present invention.
Figure 7:
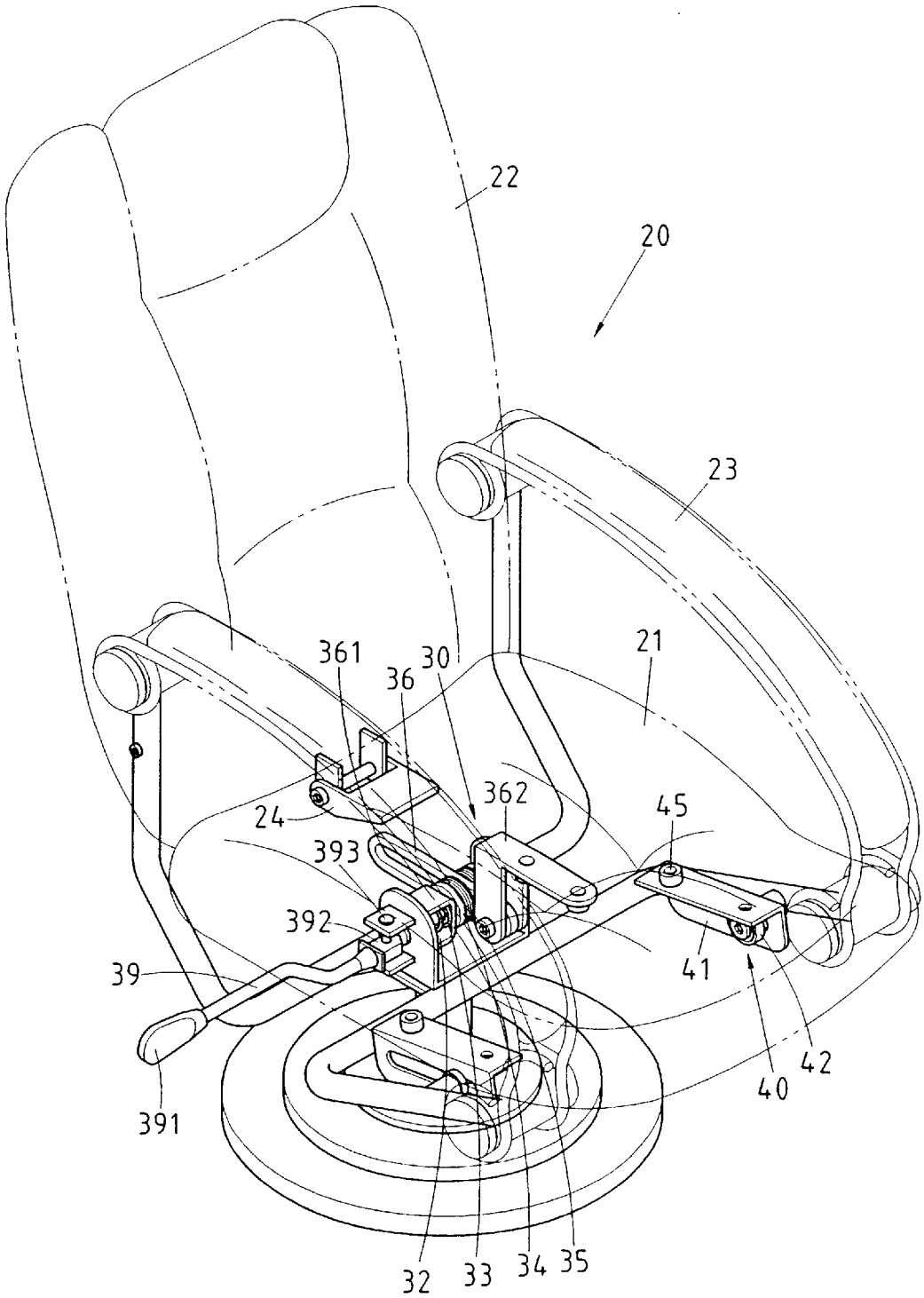
FIG. 7 shows a schematic view of the present invention at work.
Figure 8:
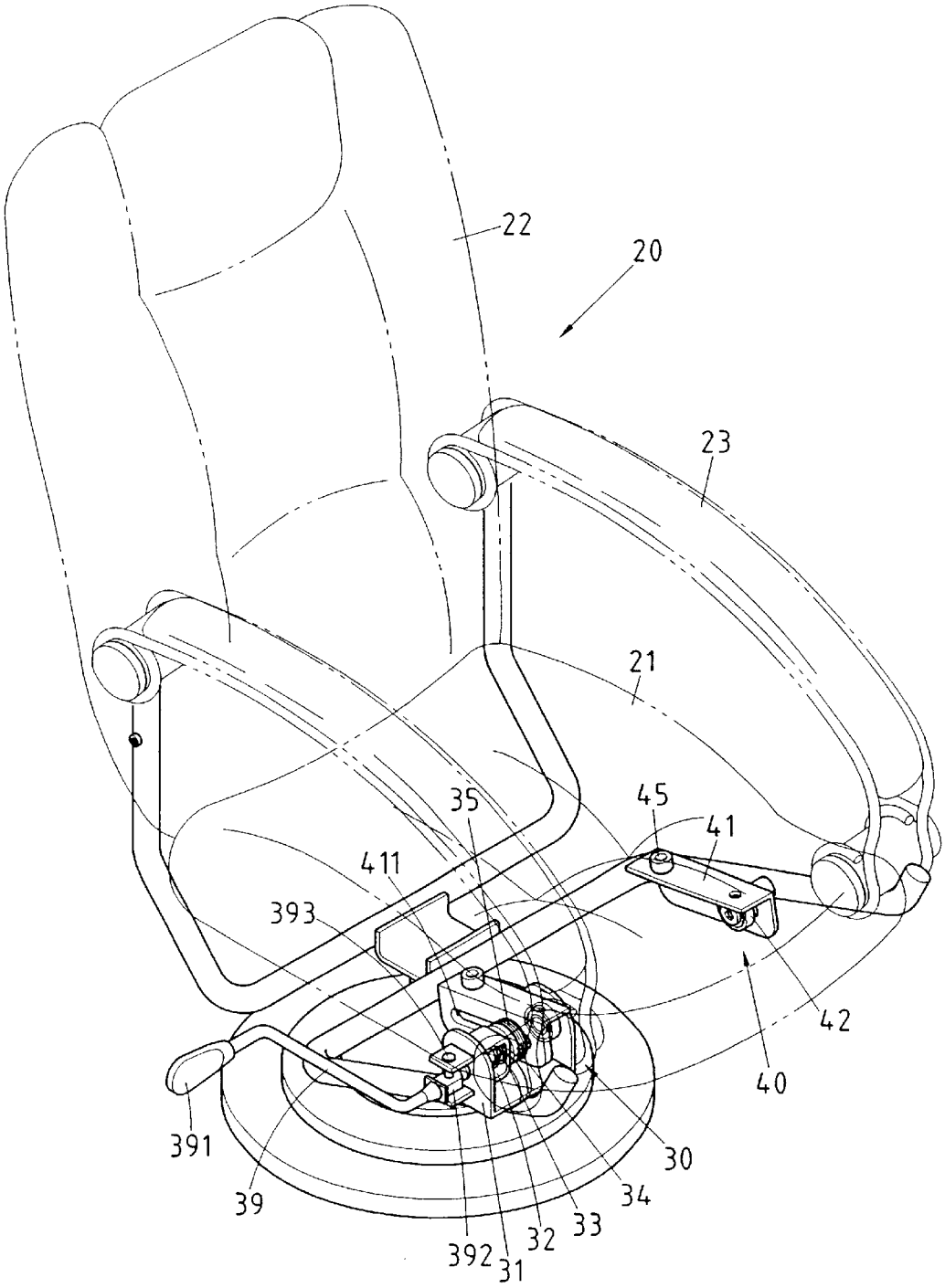
FIG. 8 shows another schematic view of the present invention at work.
Figure 9:
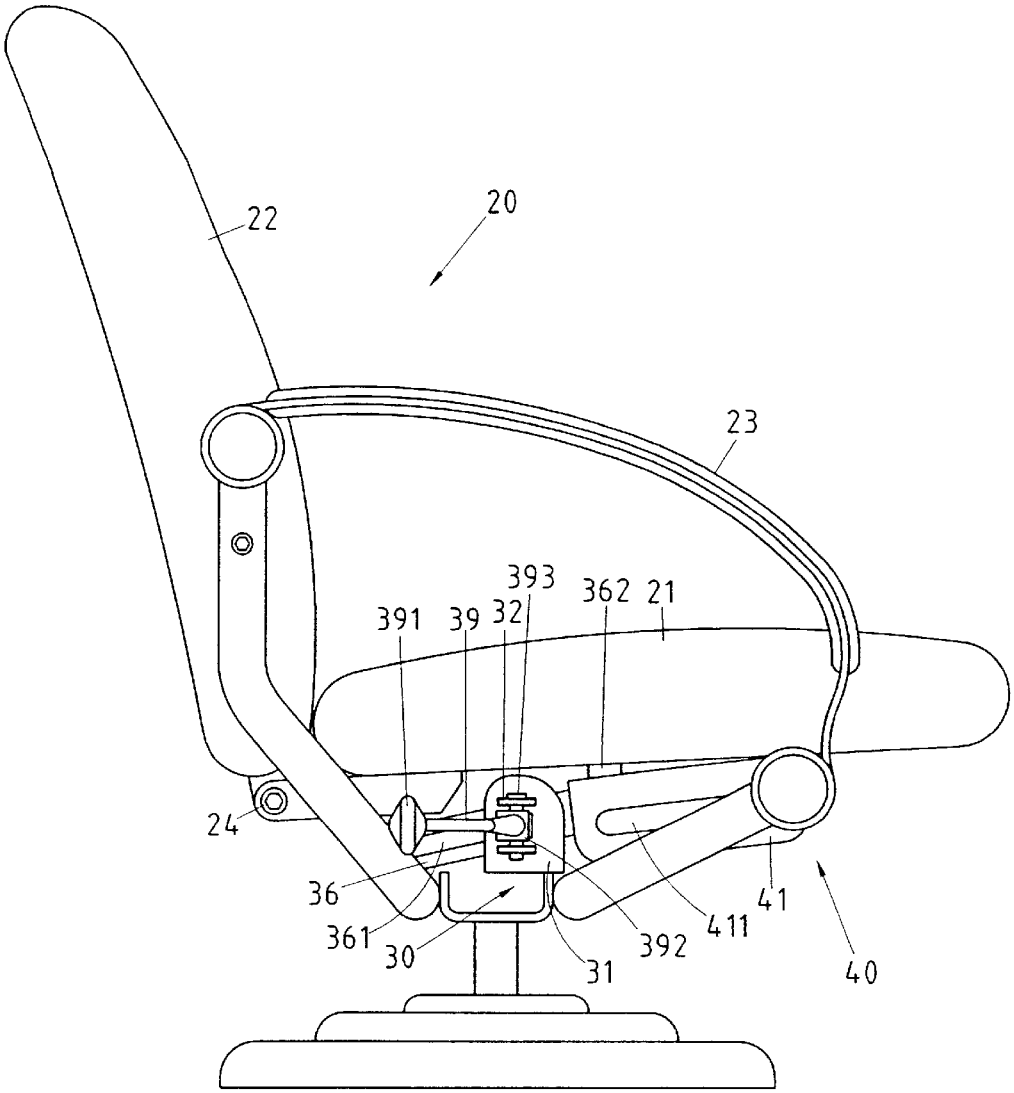
FIG. 9 shows still another schematic view of the present invention at work.
Figure 10:
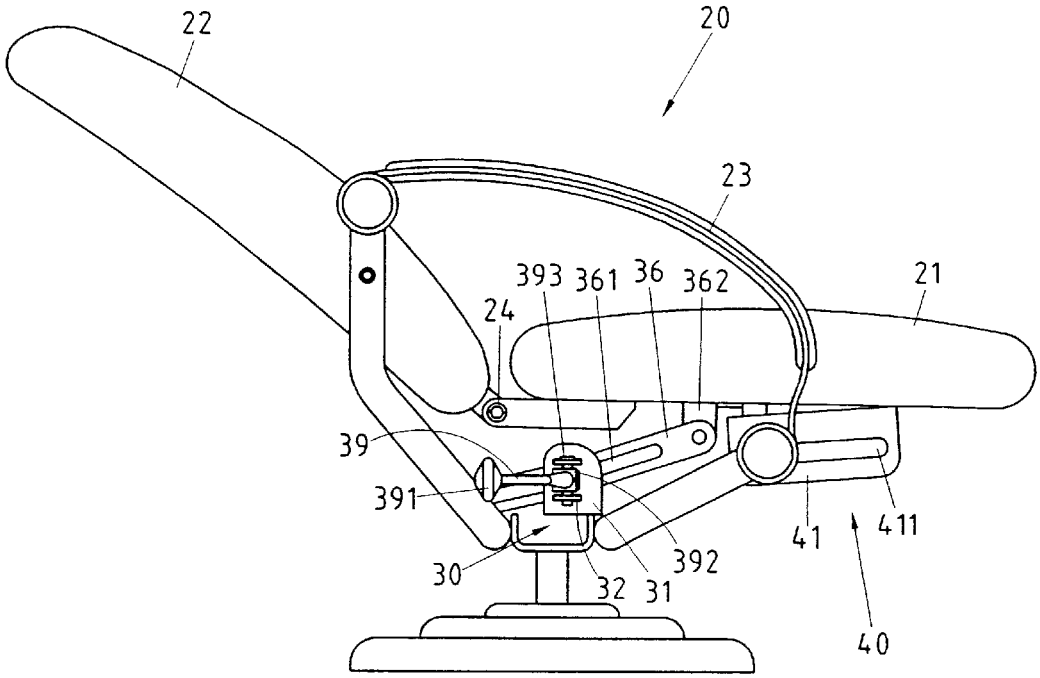
FIG. 10 shows still another schematic view of the present invention at work.

As shown in FIGS. 5, 6, and 8, a reclining leisure chair of the present invention comprises a main body 20, which is provided in two sides of the front edge thereof with a sliding member 40. A locating member 30 is disposed at any one of the two sliding members 40.

The locating member 30 comprises the component parts which are described hereinafter.

A U-shaped frame seat 31 is integrally made of a plate by bending and is provided in two sides with a coaxial hole 311. One of the two coaxial holes 311 is provided in the upper side and the lower side with a long hole 312 for disposing an action member 32 in conjunction with a resilient member 33. An auxiliary piece 34, a clamping piece 35, a slide guide plate 41, and a guide wheel 42 are disposed in the U-shaped frame seat 31. The above component parts are fastened to the U-shaped frame seat 31 by a bolt 37.

The action member 32 is integrally made of a plate by bending and is disposed in the two long holes 312 in conjunction with the resilient member 33. The action member 32 presses against the auxiliary piece 34 and is provided with an action rod 39 pivoted thereto.

The resilient member 33 is located in the U-shaped frame seat 31 by the bolt 37 such that the resilient member 33 is disposed between the U-shaped frame seat 31 and the action member 32.

The auxiliary piece 34 is located in the U-shaped frame seat 31 by the bolt 37 such that the auxiliary piece 34 is contiguous to the action member 32 and the clamping piece 35.

The clamping piece 35 is located in the U-shaped frame seat 31 by the bolt 37 such that the clamping piece 35 is contiguous to the auxiliary piece 34 and the slide guide plate 41.

The bolt 37 has an appropriate length and a stop end 371. The bolt 37 is put through the coaxial holes 311 of the U-shaped frame seat 31 to locate the action member 32, the resilient member 33, the auxiliary piece 34, the clamping piece 35, the slide guide plate 41, and the liner 38. The bolt 37 is fastened at a fastening end to the frame seat 31.

The action rod 39 has an action end 392 which is pivoted with the action member 32 by an insertion pin 393. The action rod 39 further has a wrenching end 392.

The slide guide plate 41 is disposed at an appropriate position of the front edge of the main body 20 and is provided with a guide hole 411 in which the bolt 37 is received. The slide guide plate 41 is in contact with the clamping piece 35.

Figure 15:
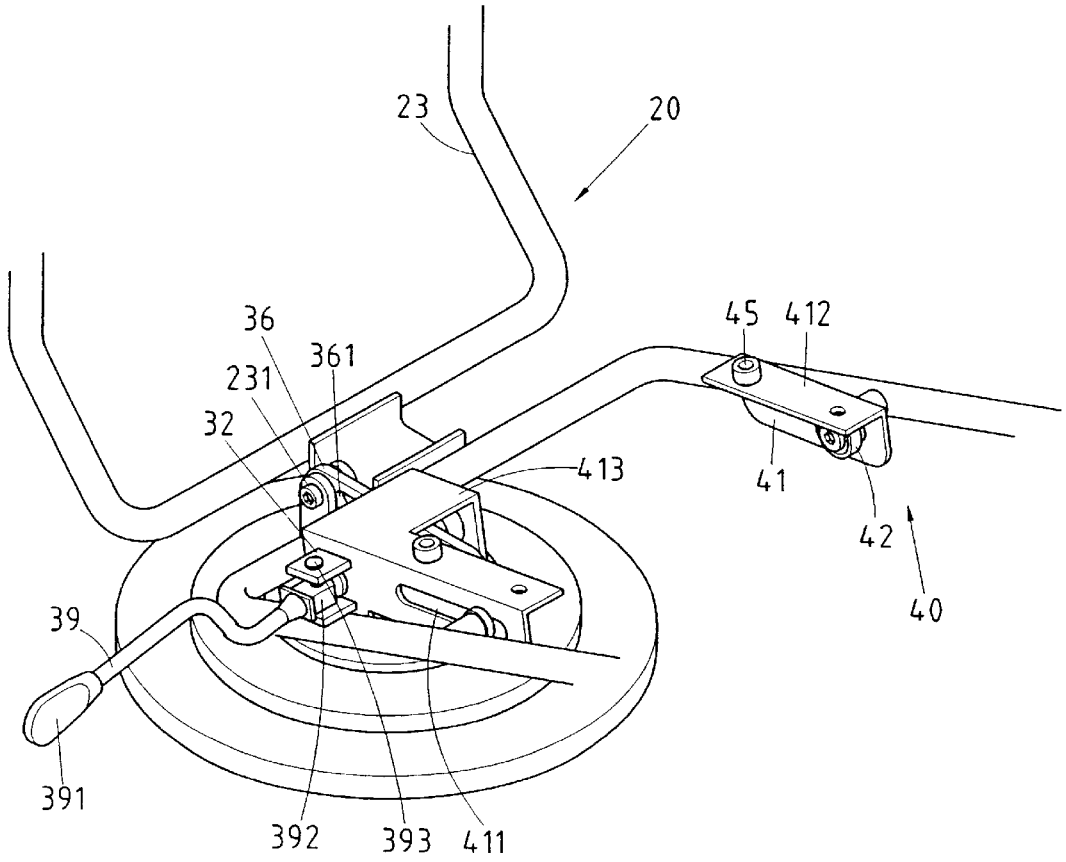
FIG. 15 shows a perspective view of the present invention.
Figure 16:
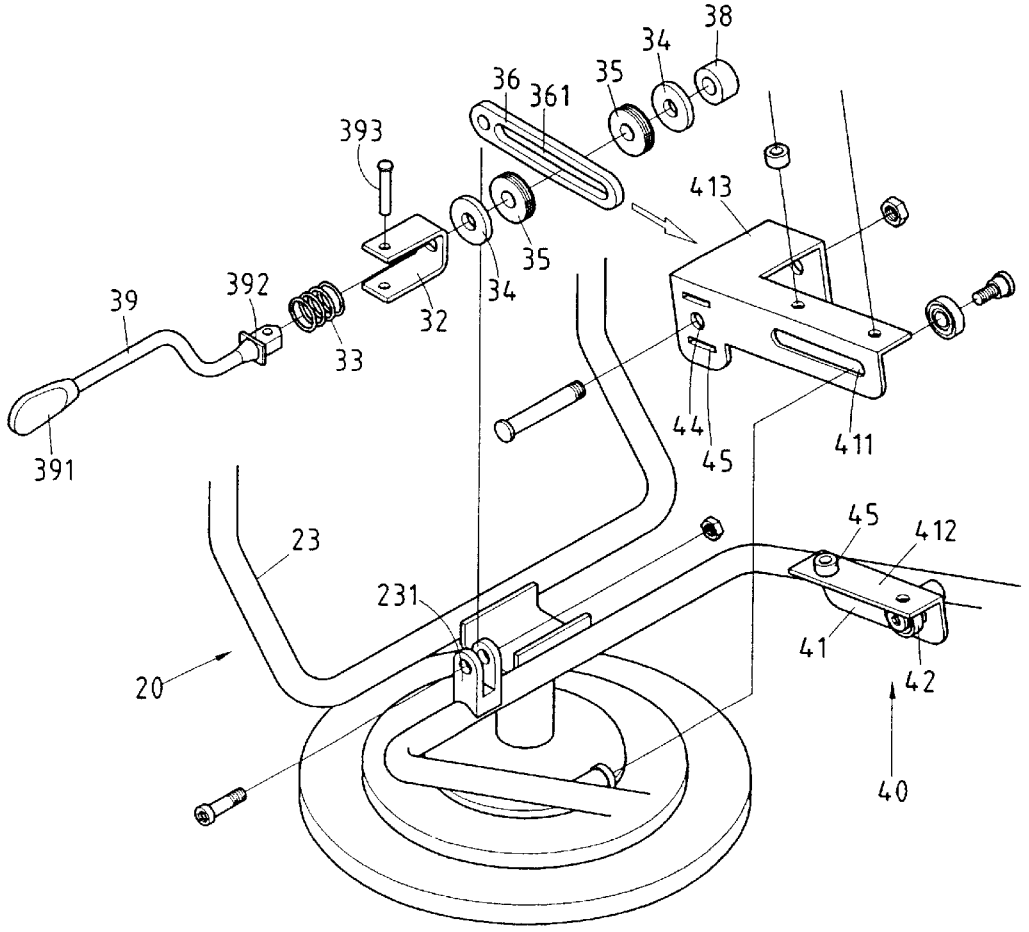
FIG. 16 shows an exploded view of the present invention.
Figure 17:
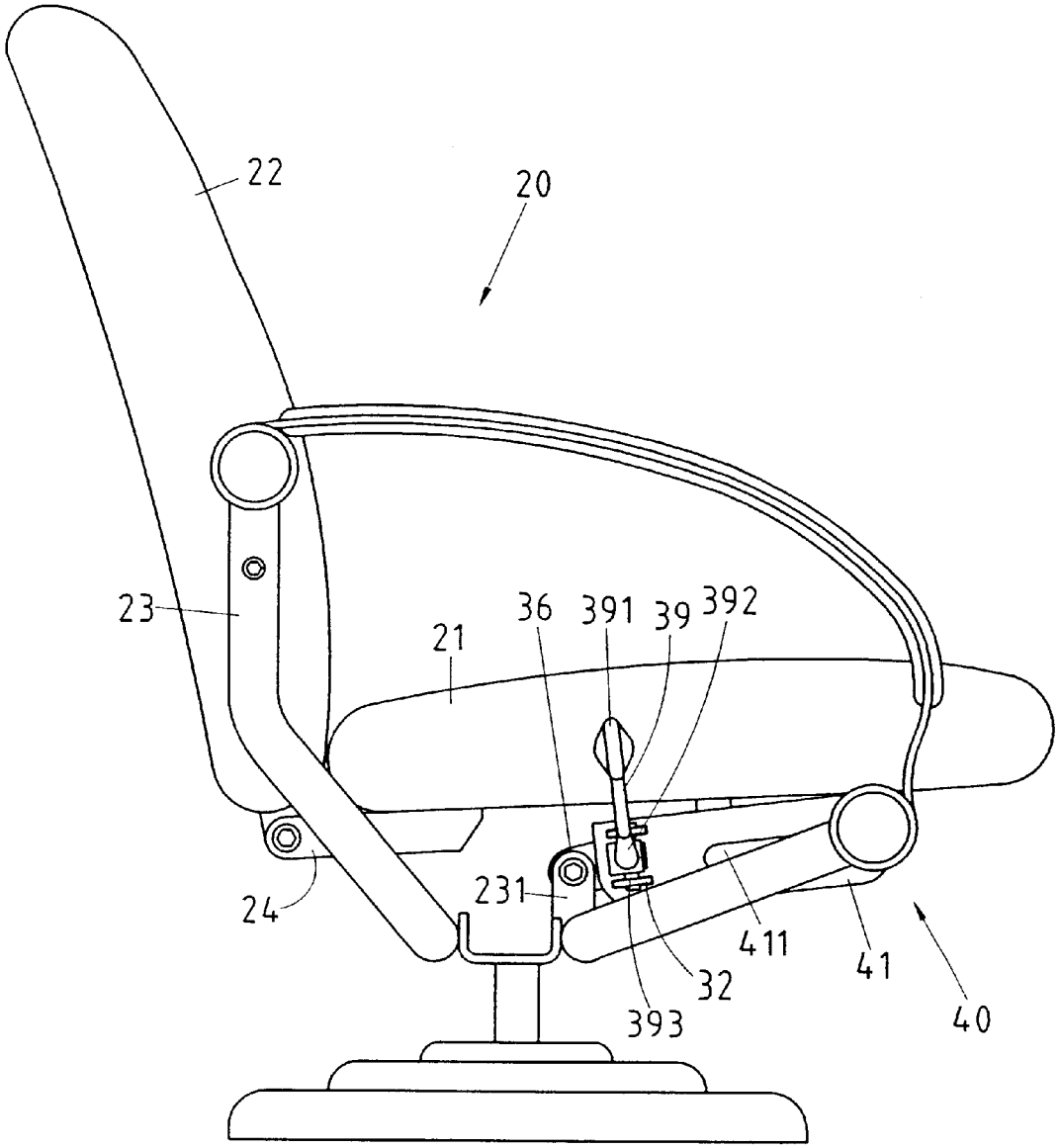
FIG. 17 shows a side schematic view of the present invention in use.

As shown in FIGS. 15, 16, and 17, a reclining leisure chair of the present invention comprises a main body 20, two sliding members 40 disposed in two sides of the front edge of the main body 20, and a locating member 30 disposed at any one of the two sliding members 40. The locating member 30 comprises the component parts which are described hereinafter.

A slide guide plate 41 is disposed at an appropriate position of the front edge of the main body 20 and is provided with an inverted U-shaped frame seat 413 which is in turn provided with two coaxial holes 414 and two long holes 415 for mounting an action member 32 in conjunction with a resilient member 33. An auxiliary piece 34, a clamping piece 35, an arresting member 36, and a liner 38 are mounted in the inverted U-shaped frame seat 413 by a bolt 37.

The action member 32 is integrally made of a plate by bending and is disposed in the two long holes 415 of the frame seat 413 in conjunction with the resilient member 33 such that action member 32 is in contact with the auxiliary piece 34. The action member 32 is provided with an action rod 39 pivoted thereto.

The resilient member 33 is disposed between the frame seat 413 and the action member 32 and is located by the bolt 37.

The auxiliary piece 34 is located in the frame seat 413 by the bolt 37 and is contiguous to the action member 32 and the clamping piece 35.

The clamping piece 35 is located in the frame seat 413 by the bolt 37 and is contiguous to the auxiliary piece 34 and the arresting member 36.

The arresting member 36 is provided with a position confining hole 361 in which the bolt 37 is received. The arresting member 61 is in contact with the clamping piece 35 and is pivoted with the pivoting lug 231 of an armrest base 23 and the arresting member 36 capable of swiveling.

The bolt 37 has an appropriate length and a stop end 371. The bolt 37 is received in the coaxial holes 414 of the inverted U-shaped frame seat 413 such that the action member 32, the resilient member 33, the auxiliary piece 34, the clamping piece 35, the arresting member 36, and the liner 38 are mounted on the bolt 37.

The action rod 39 has an action end 392 which is pivoted with the action member 32 by a pivoting pin 393. The action rod 39 has a wrenching end 391 opposite to the action end 392.

The main body 20 of the reclining leisure chair of the present invention comprises a seat 21, a backrest 22, and an armrest base 23. The seat 21 and the backrest 22 are pivotally fastened together by a pivoting member 24 such that the backrest 22 is pivoted with the armrest base 23. The locating member 30 and the sliding members 40 are fastened with the seat 21 and the armrest base 23.

The sliding member 40 of the present invention comprises a slide guide plate 41 and a guide wheel 42. The slide guide plate 41 is provided with a guide hole 411 and is fastened to the seat 21. The guide wheel 42 is pivoted with the armrest base 23.

Figure 11:
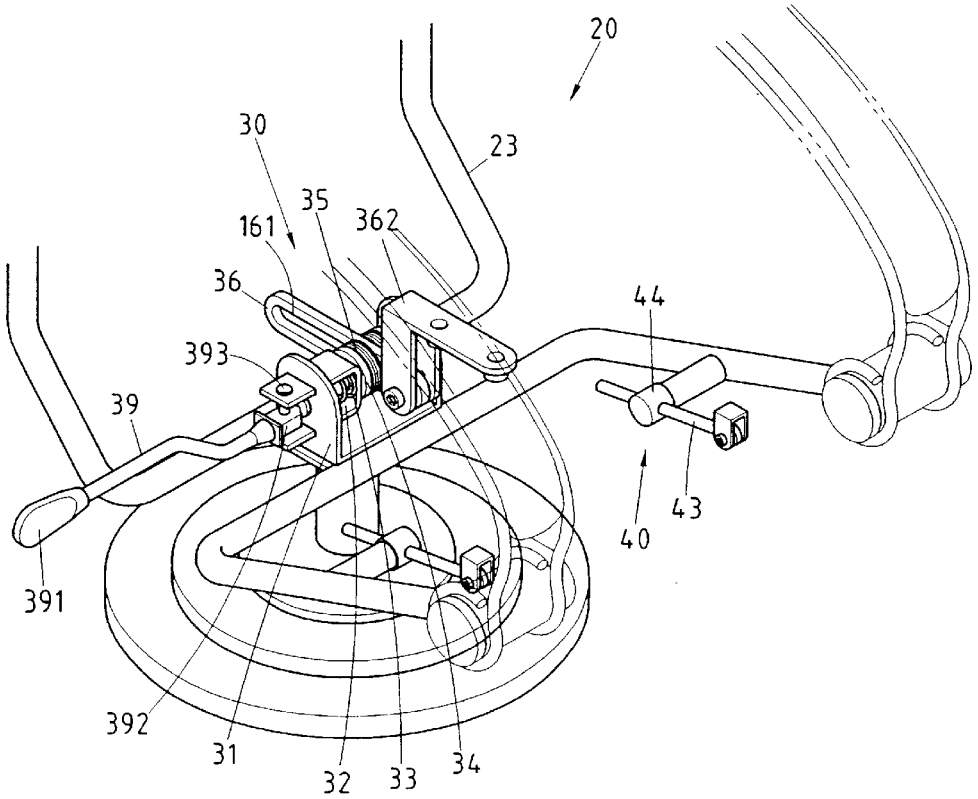
FIG. 11 shows a schematic view of an embodiment of the present invention.
Figure 12:
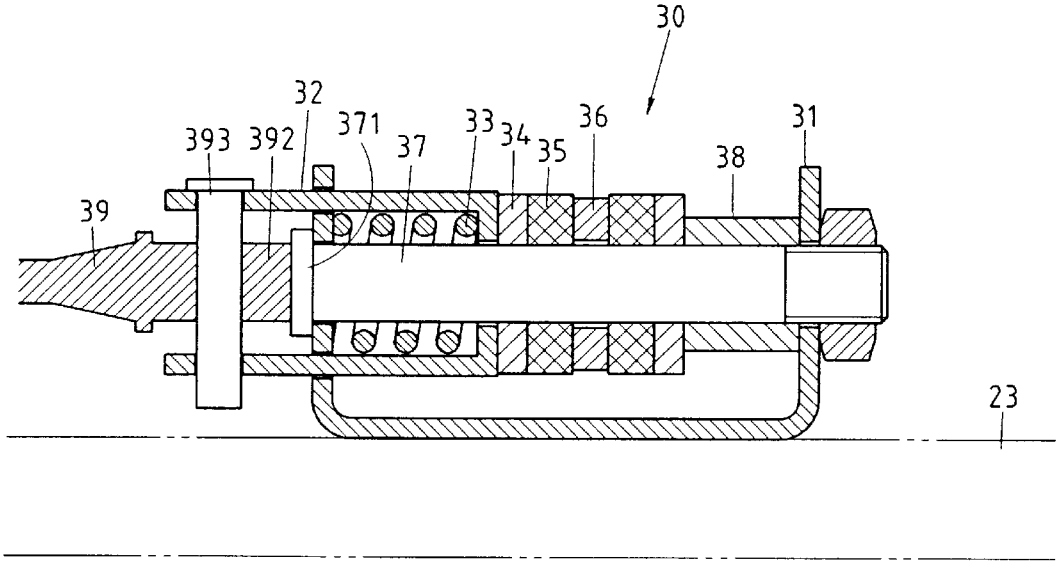
FIG. 12 shows a sectional view of the present invention.

The sliding member 40 of the present invention comprises a slide rod 43, which is fastened at one end to the seat 21 such that the other end of the slide rod 43 is fitted into a slide sleeve 44. The slide rod 43 is thus capable of sliding in the slide sleeve 44 at the time when the seat 21 is in action, as shown in FIG. 11.

Figure 3:
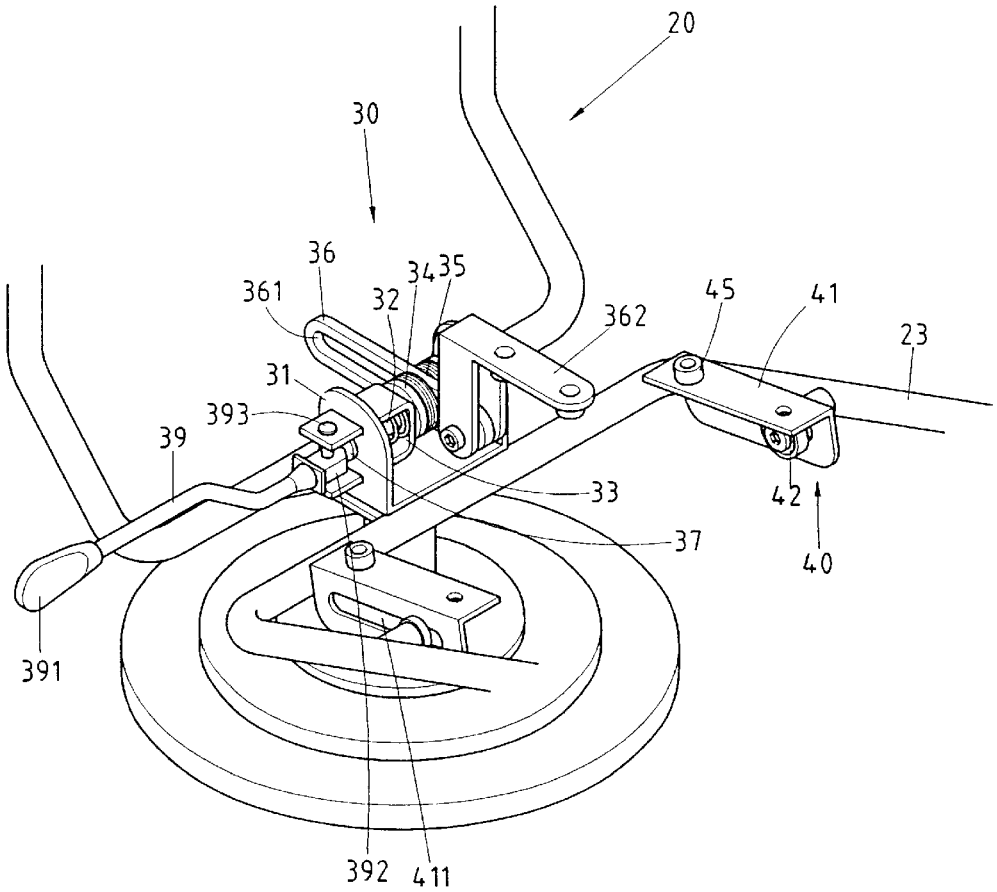
FIG. 3 shows a perspective view of the present invention.
Figure 4:
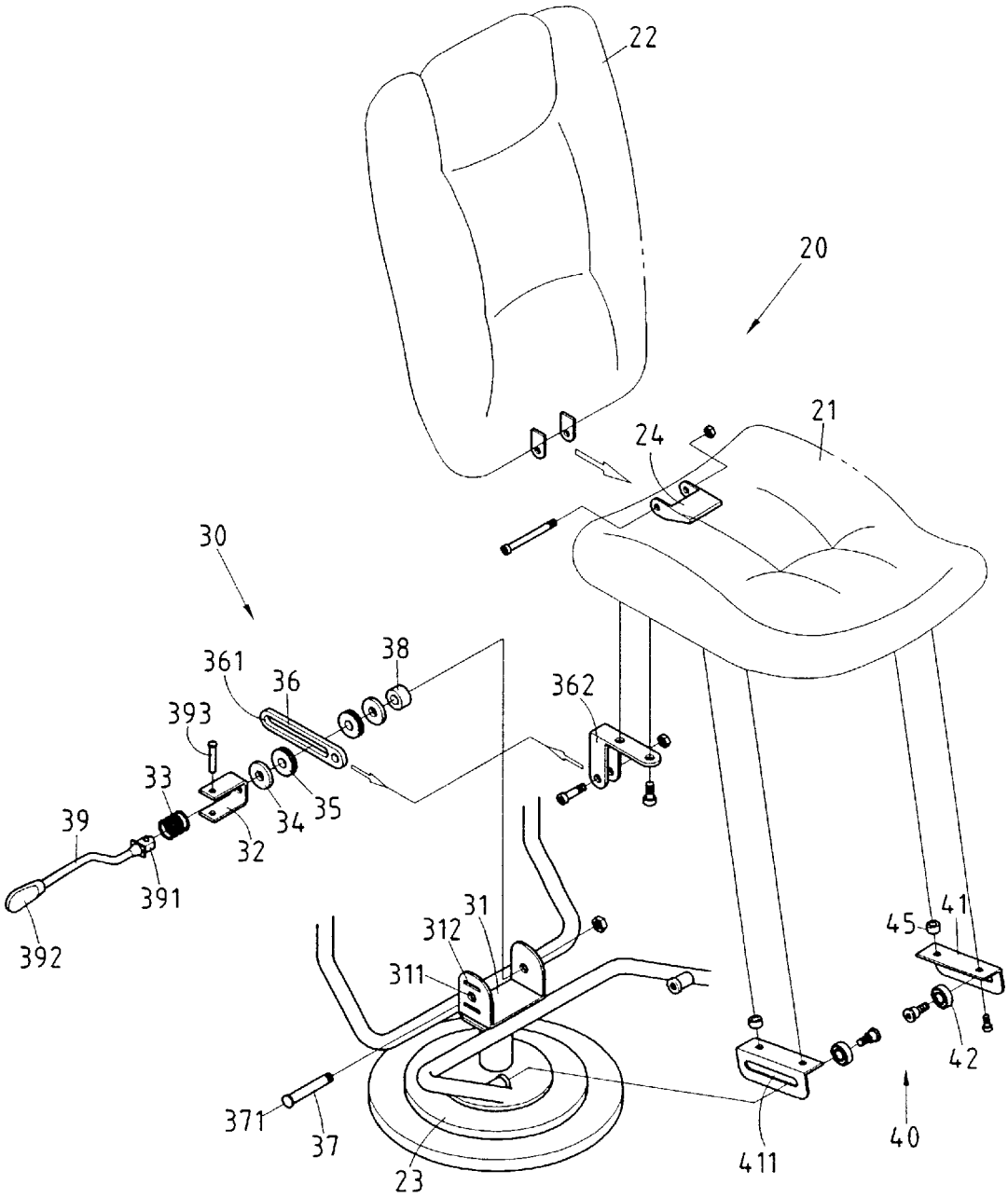
FIG. 4 shows an exploded view of the present invention.

The action member 32 of the reclining leisure chair of the present invention juts out of the long hole 312 of the U-shaped frame seat 31, as shown in FIGS. 3 and 4.

The reclining leisure chair of the present invention comprises at least two auxiliary pieces 34, which are located at two sides of the arresting member 36 and are in contact with the clamping piece 35, as shown in FIGS. 4 and 16.

The reclining leisure chair of the present invention comprises at least two auxiliary pieces 34, which are located at two sides of the slide guide plate 41 and are in contact with the clamping piece 35, as shown in FIG. 6.

As shown in FIGS. 3, 4, 12, 15, and 16, the present invention comprises at least two clamping pieces 35, which are located at two sides of the arresting member 36 and are in contact with the auxiliary piece 34 and the arresting member 36.

Figure 13:
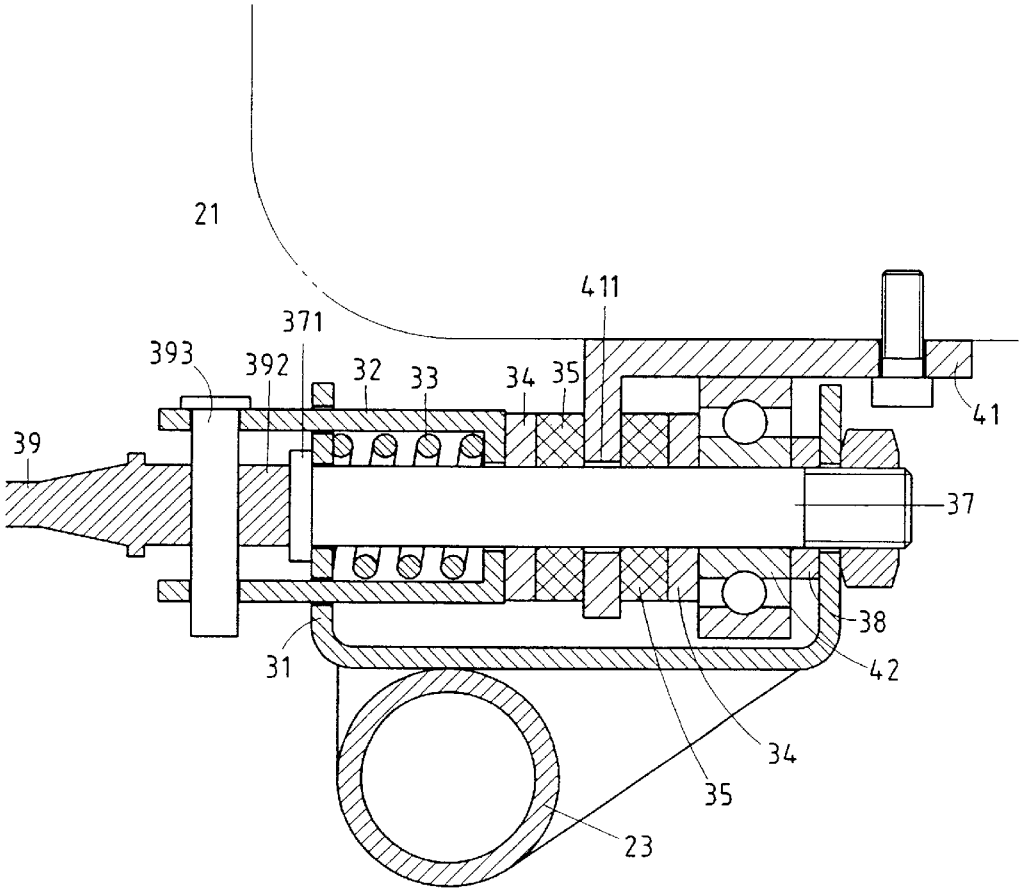
FIG. 13 shows another sectional view of the present invention.

As shown in FIGS. 5, 6, and 13, the present invention comprises at least two clamping pieces 35, which are located at two sides of the slide guide plate 41 and are in contact with the auxiliary piece 34 and the slide guide plate 41.

As shown in FIGS. 3, 4, 12, 15, and 16, the clamping piece 35 of the present invention has a width greater than a width of the position confining hole 361 of the arresting member 36.

As shown in FIGS. 5, 6, and 13, the clamping piece 35 of the present invention has a width greater than a width of the guide hole 411 of the slide guide plate 41.

As illustrated in FIGS. 14A and 14B, the resilient member 33 of the present invention is compressed or decompressed by the action member 32 which is actuated by the action rod 39 by means of a profile distance difference of the action end 392 of the action rod 39.

The slide guide plate 41 of the reclining leisure chair of the present invention has an adjustment block 45 by means of which the slide guide plate 41 is located at the bottom edge of the seat 21 at an appropriate inclination.

The guide wheel 42 of the sliding member 40 of the reclining leisure chair of the present invention is moved along the bottom edge of a top plate 412 of the slide guide plate 41.

As illustrated in FIGS. 3–17, the leisure chair of the present invention is reclined by turning the wrenching end 391 of the action rod 39 such that the backrest 22 is in the reclining position, and that the seat 21 is pushed forward via the pivoting member 24, and further that the guide wheel 42 of the sliding member 40 moves along the bottom edge of the top plate 412 of the slide guide plate 41, thereby resulting in an appropriate adjustment of the main body 20. In other words, when the action rod 39 is activated, the action member 32 is caused to displace toward the outer side of the U-shaped frame seat 31 or the inverted U-shaped frame seat 413 such that the action member 32 compresses the resilient member 33, and that the arresting member 36 or the slide guide plate 41 is relieved of the clamping force of the clamping piece 35. As a result, the seat 21 and the backrest 22 of the reclining leisure chair of the present invention are adjusted in position so as to enable the leisure chair of the present invention to be in a reclining position. As the action rod 39 is turned back to its original position, the recovery force of the resilient member 33 causes the auxiliary piece 34 and the clamping piece 35 to securely hold the arresting member 36 or the slide guide plate 41. The wrenching end 391 of the action rod 39 is extended out of the seat 21 and is therefore accessible to the hand of a person seated on the reclining leisure chair of the present invention.

The present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

I claim:

1. A reclining leisure chair comprising a main body, a locating member disposed at a rear edge of said main body, and two sliding members disposed respectively at two sides of a front edge of said main body; wherein said locating member comprises:

a U-shaped frame seat integrally made of a plate by bending and comprised of two coaxial holes and two long holes for mounting an action member, a resilient member, an auxiliary piece, a clamping piece, an arresting member, and a liner in said U-shaped frame seat in conjunction with a bolt;

said action member being integrally formed of a plate by bending and being disposed in said two long holes of said U-shaped frame seat along with said resilient member such that said action member is in contact with said auxiliary piece whereby said action member is provided with an action rod pivoted thereto;

said resilient member being disposed between said U-shaped frame seat and said action member such that said resilient member is located by said bolt;

said auxiliary piece being located in said U-shaped frame seat by said bolt such that said auxiliary piece is contiguous to said action member and said clamping piece;

said clamping piece being located in said U-shaped frame seat by said bolt such that said clamping piece is contiguous to said auxiliary piece and said action member; said arresting member provided with a position confining hole through which said bolt is received, said arresting member being in contact with said clamping piece and being provided with a pivoting member enabling said arresting member to swivel;

said bolt having an appropriate length, a stop end, and a fastening end, said bolt being put through said two coaxial holes of said U-shaped frame seat such that said fastening end is fastened to said U-shaped frame seat, and that said action member, said resilient member, said auxiliary piece, said clamping piece, said arresting member, and said liner are mounted on said bolt;

said action rod having a wrenching end and an action end whereby said action end is pivoted with said action member by an insertion pin.

2. The reclining leisure chair as defined in claim 1, wherein said main body further comprises a seat, a backrest and an armrest seat, said seat being pivoted with said backrest which is in turn pivoted with said armrest seat; wherein said locating member and said sliding members are disposed at said seat and said armrest seat.

3. The reclining leisure chair as defined in claim 2, wherein said sliding members further comprise a slide guide plate and a guide wheel, said slide guide plate provided with a guide hole and fastened to said seat, said guide wheel being pivoted with said armrest seat.

4. The reclining leisure chair as defined in claim 5, wherein said slide guide plate is comprised of an adjustment block; wherein said seat is fastened to said adjustment block such that said seat and said adjustment block form an inclination.

5. The reclining leisure chair as defined in claim 3, wherein said slide guide plate is comprised of a top plate; wherein said guide wheel slides along said top plate of said slide guide plate.

6. The reclining leisure chair as defined in claim 3, wherein said resilient member is compressed by said action member at the time when said action rod is turned an angle to activate said action member, thereby relieving said arresting member and said slide guide plate of a clamping force of said clamping piece so as to enable said seat and said backrest of said main body to be adjusted whereby said resilient member is compressed to conserve a recovery force which forces said auxiliary piece and said clamping piece to hold securely arresting member and said slide guide plate at such time when said action rod is returned to an original position thereof to deactivate said action member.

7. The reclining leisure chair as defined in claim 2, wherein said sliding members further comprise a slide rod which is fastened at one end to said seat such that another end of said slide rod is fitted into a slide sleeve whereby said other end of said slide rod slides in said slide sleeve at the time when said seat is in motion.

8. The reclining leisure chair as defined in claim 1, wherein said action member juts out of said U-shaped frame seat via said long hole.

9. The reclining leisure chair as defined in claim 1, wherein said locating member further comprises two auxiliary pieces which are located in two sides of said arresting member and are contiguous to said clamping piece.

10. The reclining leisure chair as defined in claim 1, wherein said locating member further comprises two clamping pieces which are located in two sides of said arresting member and are contiguous to said auxiliary piece and said arresting member.

11. The reclining leisure chair as defined in claim 1, wherein said clamping piece is greater in width than said position confining hole of said arresting member.

12. The reclining leisure chair as defined in claim 1, where said action end of said action rod makes use of a wheel profile distance difference to enable said action rod to actuate said action member to compress or decompress said resilient member.

13. A reclining leisure chair comprising a main body, two sliding members disposed respectively at two sides of a front edge of said main body, and a locating member disposed at any one of said two sliding members; wherein said locating member comprises:

an U-shaped frame seat integrally made of a plate by bending and comprised of two coaxial holes and two long holes for disposing an action member, a resilient member, an auxiliary piece, a clamping piece, a slide guide plate, and a guide wheel in said U-shape ed frame seat in conjunction with a bolt;

said action member being integrally formed of a plate by bending and being disposed in said two long holes of said U-shaped frame seat along with said resilient member such that said action member is in contact with said auxiliary piece whereby said action member is provided with an action rod pivoted thereto; said resilient member being disposed between said U-shaped frame seat and said action member such that said resilient member is located by said bolt; said auxiliary piece being located in said U-shaped frame seat by said bolt such that said auxiliary piece is contiguous to said action member and said clamping piece;

said clamping piece being located in said U-shaped frame seat by said bolt such that said clamping piece is contiguous to said auxiliary piece and said slide guide plate;

said bolt having an appropriate length, a stop end, and a fastening end, said bolt being received in said two long holes of said U-shaped frame seat to locate said action member, said resilient member, said auxiliary piece, said clamping piece, said slide guide plate, and a liner, said fastening end of said bolt being fasten ed to said U-shaped frame seat;

said action rod having a wrenching end, and an action end which is pivoted with said action member by an insertion pin;

said slide guide plate being disposed in the front edge of said main body and provided with a guide hole through which said bolt is put whereby said slide guide plate is in contact with said clamping piece.

14. The reclining leisure chair as defined in claim 13, wherein said main body further comprises a seat, a backrest, and an armrest seat, said seat being pivoted with said backrest which is in turn pivoted with said armrest seat; wherein said locating member and said sliding members are disposed at said seat and said armrest seat.

15. The reclining leisure chair as defined in claim 14, wherein said sliding members further comprise a slide guide plate and a guide wheel, said slide guide plate provided with a guide hole and fastened to said seat of said main body, said guide wheel being pivoted with said armrest seat of said main body.

16. The reclining leisure chair as defined in claim 15, wherein said locating member further comprises two auxiliary pieces which are located in two sides of said slide guide plate and are contiguous to said clamping piece.

17. The reclining leisure chair as defined in claim 15, wherein said locating member further comprises two clamping pieces which are located in two sides of said slide guide plate and are contiguous to said auxiliary piece and said slide guide plate.

18. The reclining leisure chair as defined in claim 15, wherein said clamping piece is greater in width than said guide hole of said slide guide plate.

19. The reclining leisure chair as defined in claim 15, wherein said slide guide plate is comprised of an adjustment block; wherein said seat of said main body is fastened to said adjustment block such that said seat and said adjustment block form an inclination.

20. The reclining leisure chair as defined in claim 15, wherein said slide glide plate is comprised of a top plate; wherein said guide wheel slides along said top plate of said slide guide plate.

21. The reclining leisure chair as defined in claim 15, wherein said resilient member is compressed by said action member at the time when said action rod is turned an angle to activate said action member, thereby relieving said arresting member and said slide guide plate of a clamping force of said clamping piece so as to enable said seat and said backrest of said main body to be adjusted whereby said resilient member is compressed to conserve a recovery force which forces said auxiliary piece and said clamping piece to hold securely arresting member and said slide guide plate at such time when said action rod is returned to an original position thereof to deactivate said action member.

22. The reclining leisure chair as defined in claim 13, wherein said action member juts out of said U-shaped frame seat via said long hole.

23. The reclining leisure chair as defined in claim 13, wherein said action end of said action rod makes use of a wheel profile distance difference to enable said action rod to actuate said action member to compress or decompress said resilient member.

24. A reclining leisure chair comprising a main body, two sliding members disposed respectively in two sides of a front edge of said main body, and a locating member disposed at any one of said two sliding members; wherein said locating member comprises:

a slide guide plate disposed in the front edge of said main body and comprised of an inverted U-shaped frame seat having two coaxial holes and two long holes for disposing an action member, a resilient member, an auxiliary piece, a clamping piece, an arresting member, and a liner in said inverted U-shaped frame seat in conjunction with a bolt;

said action member being formed integrally of a plate by bending and being disposed in said two long holes of said inverted U-shaped frame seat along with said resilient member such that said action member is in contact with said auxiliary piece whereby said action member is provided with an action rod pivoted thereto;

said resilient member being disposed between said inverted U-shaped frame seat and said action member such that said resilient member is located by said bolts;

said auxiliary piece being located in said inverted U-shaped frame seat by said bolt such that said auxiliary piece is contiguous to said action member and said clamping piece;

said clamping piece being located in said inverted U-shaped frame seat such that said clamping piece is contiguous to said auxiliary piece and said arresting member;

said arresting member being provided with a position confining hole through which said bolt is put, said arresting member being in contact with said clamping piece whereby said arresting member is pivoted with a pivoting lug of an armrest seat;

said bolt having an appropriate length, a stop end, and a fastening end for fastening said bolt to said inverted U-shaped frame seat, said bolt being put through said coaxial holes of said inverted U-shaped frame seat to locate said action member, said resilient member, said auxiliary piece, said clamping piece, said arresting member, and said liner in said inverted U-shaped frame seat;

said action rod having a wrenching end and an action member which is pivoted with said action member by an insertion pin.

25. The reclining leisure chair as defined in claim 24, wherein said main body further comprises a seat, a backrest, and an armrest seat, said seat being pivoted with said backrest which is in turn pivoted with said armrest seat; wherein said locating member and said sliding members are disposed at said seat and said armrest seat.

26. The reclining leisure chair as defined in claim 25, wherein said sliding members further comprise a slide guide plate and a guide wheel, said slide guide plate provided with a guide hole and fastened to said seat of said main body, said guide wheel being pivoted with said armrest seat of said main body.

27. The reclining leisure chair as defined in claim 26, wherein said slide guide plate is comprised of an adjustment block, wherein said seat of said main body is fastened with said adjustment block such that said seat and said adjustment block form an inclination.

28. The reclining leisure chair as defined in claim 26, wherein said slide guide plate is comprised of a top plate, wherein said guide wheel slides along said top plate of said slide guide plate.

29. The reclining leisure chair as defined in claim 26, wherein said resilient member is compressed by said action member at the time when said action rod is turned an angle to activate said action member, thereby relieving said arresting member and said slide guide plate of a champing force of said clamping piece so as to enable said seat and said backrest of said main body to be adjusted whereby said resilient member is compressed to conserve a recovery force which forces said auxiliary piece and said clamping piece to hold securely said arresting member and said slide guide plate at such time when said action rod is returned to an original position thereof to deactivate said action member.

30. The reclining leisure chair as defined in claim 24, wherein said locating member further comprises two auxiliary pieces which are located in two sides of said arresting member and are contiguous to said clamping piece.

31. The reclining leisure chair as defined in claim 24, wherein said locating member further comprises two clamping pieces which are located in two sides of said arresting member and are contiguous to said auxiliary piece and said arresting member.

32. The reclining leisure chair as defined in claim 24, wherein said clamping piece is greater in width than said position confining hole of said arresting member.

33. The reclining leisure chair as defined in claim 24, wherein said action end of said action rod makes use of a wheel profile distance difference to enable said action rod to actuate said action member to compress or decompress said resilient member.

* * * * *